US007773894B2

(12) United States Patent
Shirakata

(10) Patent No.: US 7,773,894 B2
(45) Date of Patent: Aug. 10, 2010

(54) IMAGE FORMING APPARATUS

(75) Inventor: Jiro Shirakata, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 492 days.

(21) Appl. No.: 11/751,447

(22) Filed: May 21, 2007

(65) Prior Publication Data

US 2007/0297820 A1 Dec. 27, 2007

(30) Foreign Application Priority Data

Jun. 26, 2006 (JP) ..... 2006-175572

(51) Int. Cl.
*G03G 15/00* (2006.01)

(52) U.S. Cl. ..... 399/44; 399/94; 399/167; 399/396

(58) Field of Classification Search ..... 399/38, 399/44, 91, 94, 159, 162, 167, 297, 298, 399/301, 302, 308, 394–396; 347/116
See application file for complete search history.

(56) References Cited

U.S. PATENT DOCUMENTS 5,272,492 A * 12/1993 Castelli ..... 347/116
2005/0238372 A1* 10/2005 Shinohara et al. ..... 399/44

FOREIGN PATENT DOCUMENTS

JP 2005-156877 A 6/2005

* cited by examiner

*Primary Examiner*—David P Porta
*Assistant Examiner*—Benjamin Schmitt
(74) *Attorney, Agent, or Firm*—Canon U.S.A., Inc. I.P. Division

(57) ABSTRACT

An image forming apparatus includes an image bearing belt configured to bear a toner image, a driving roller configured to rotationally drive the image bearing belt, first and second image forming units configured to form toner images on the image bearing belt. To correct color misregistration, the image forming apparatus uses a mark detecting unit including a plurality of sensors provided at different positions in a rotation direction of the image bearing belt to detect a mark on the image bearing belt, and adjusts a rotational speed of the driving roller, based on detection results of the mark detecting unit and temperature detected within the image forming apparatus.

12 Claims, 11 Drawing Sheets

IMAGE FORMING APPARATUS

BACKGROUND OF THE INVENTION

1. Field of the Invention

The present invention relates to an image forming apparatus which corrects so-called color misregistration, which is offset among multiple toner images provided on an image bearing member, by detecting a mark on the image bearing member using multiple sensors provided away from one another in the direction of movement of an image bearing belt.

2. Description of the Related Art

Japanese Patent Laid-Open No. 2005-156877 describes a technique wherein a mark provided on an intermediate transfer belt is detected by multiple sensors disposed at predetermined intervals in the direction of movement of the intermediate transfer belt (image bearing member). The speed of the intermediate transfer belt is calculated from the detection results of the sensors. The speed of the intermediate transfer belt changes according to change in the diameter of the driving rollers which rotate the intermediate transfer belt, leading to color misregistration. The image forming apparatus in Japanese Patent Laid-Open No. 2005-156877 corrects the color misregistration based on the speed calculated from the detection results of the sensors.

However, members supporting the above-mentioned sensors exhibit thermal expansion, due to the effects of change in temperature within the image forming apparatus. This thermal expansion causes change in the intervals between the sensors, leading to a state wherein precise detection cannot be performed and correction of color misregistration cannot be carried out in a precise manner.

The effects of thermal expansion of a supporting member which supports the sensors on the image will be described with an example of an image forming apparatus having multiple image forming units, wherein multiple toner images are overlaid on the intermediate transfer belt.

In a case wherein two sensors are supported at predetermined intervals by a sensor supporting member having a linear expansion coefficient of $\alpha$, and the temperature change of the supporting member is $\Delta T$, the sensor interval r between the sensors is $$r'=(1+\alpha\times\Delta T)\times r \tag{1}$$

due to the linear expansion. Accordingly, the speed V of the intermediate transfer belt in an arrangement wherein the detection interval between the two sensors is tb can be expressed as $$V=(1+\alpha\times\Delta T)\times r/tb. \tag{2}$$

However, if we measure the speed of the intermediate transfer belt without taking into consideration this linear expression, as known arrangements do, the measured belt speed Ve is $$Ve=r/tb. \tag{3}$$

The difference $\Delta V$ between the measured belt speed Ve and the true speed V of the belt is thus the error due to linear expansion of the supporting member.

$$\begin{aligned}\Delta V &= V - Ve \\ &= \alpha\times\Delta T\times r/tb\end{aligned} \tag{4}$$

Now, the positional offset amount $\Delta X$ on the intermediate transfer belt due to the speed error $\Delta V$ is as follows. Let us say that the interval between the two image forming units farthest from each other, out of the multiple image forming units, is an interval L. An image is formed by the first image forming unit of the apparatus onto the intermediate transfer belt, the intermediate transfer belt is transported by the distance L, and the apparatus is corrected such that, at precisely this time, the image formed by the second image forming unit which is at this distance is overlaid on the first image, and transferred.

Now, the target time ta to which the timing is to be set is the amount of time during which the intermediate transfer belt travels the distance L at the measured belt speed Ve, and accordingly $$ta=L/Ve \tag{5}$$

holds. The positional offset occurring during this time ta due to the speed error $\Delta V$ thus is $\Delta X$. Accordingly, $$\Delta X=\Delta V\times ta \tag{6}$$

holds, into which the Expressions (3), (4), and (5) are substituted, to yield $$\Delta X=L\times\alpha\times\Delta T \tag{7}$$

For example, with an image forming apparatus wherein the supporting member of the two sensors is formed of iron which has a linear expansion coefficient of $11.7\times10^{-6}$, and the interval between the four image forming units is 100 mm, temperature fluctuation of 5° C. at the sensor supporting member will result in color misregistration between the image forming units farthest from each other is as follows. That is to say, the interval L between the image forming units farthest from each other is 300 mm, so the amount of color misregistration therebetween is obtained by $$\Delta X=300\times11.7\times10^{-6}\times5=0.02925\text{ mm}$$

meaning a color misregistration of around 30 μm, which is far from negligible in light of current image target values.

SUMMARY OF THE INVENTION

Accordingly, there has been recognized the need to provide an image forming apparatus capable of correcting color misregistration with high precision, regardless of the temperature within the image forming apparatus.

According to an aspect of the present invention, an embodiment is directed to an image forming apparatus comprising: an image bearing belt configured to bear a toner image; a driving roller configured to rotationally drive the image bearing belt; first and second image forming units configured to form toner images on the image bearing belt; a first sensor configured to detect a mark on the image bearing belt; a second sensor provided on a position different from that of the first sensor in a rotation direction of the image bearing belt, the second sensor being configured to detect the mark; a supporting member configured to support the first and second sensors; a temperature detecting unit configured to detect temperature within the image forming apparatus; and a rotational speed adjusting unit configured to adjust a rotational speed of the driving roller, based on detection results of the first and second sensors and of the temperature detecting unit.

According to another aspect of the present invention, an embodiment is directed to an image forming apparatus comprising: an image bearing belt configured to bear a toner image; a driving roller configured to rotationally drive the image bearing belt; first and second image forming units configured to form toner images on the image bearing belt; a first sensor configured to detect a mark on the image bearing belt; a second sensor provided on a position different from that of the first sensor in a rotation direction of the image bearing belt, the second sensor being configured to detect the mark; a supporting member configured to support the first and second sensors; a temperature detecting unit configured to detect temperature within the image forming apparatus; and an adjusting unit configured to adjust a relative position of a toner image formed on the image bearing belt by the first image forming unit and a toner image formed on the image bearing belt by the second image forming unit, based on detection results of the first and second sensors and of the temperature detecting unit.

Further features of the present invention will become apparent from the following description of exemplary embodiments (with reference to the attached drawings).

DESCRIPTION OF THE EMBODIMENTS

Embodiments of the present invention will be described in detail with reference to the attached drawings.

First Embodiment

Figure 1:
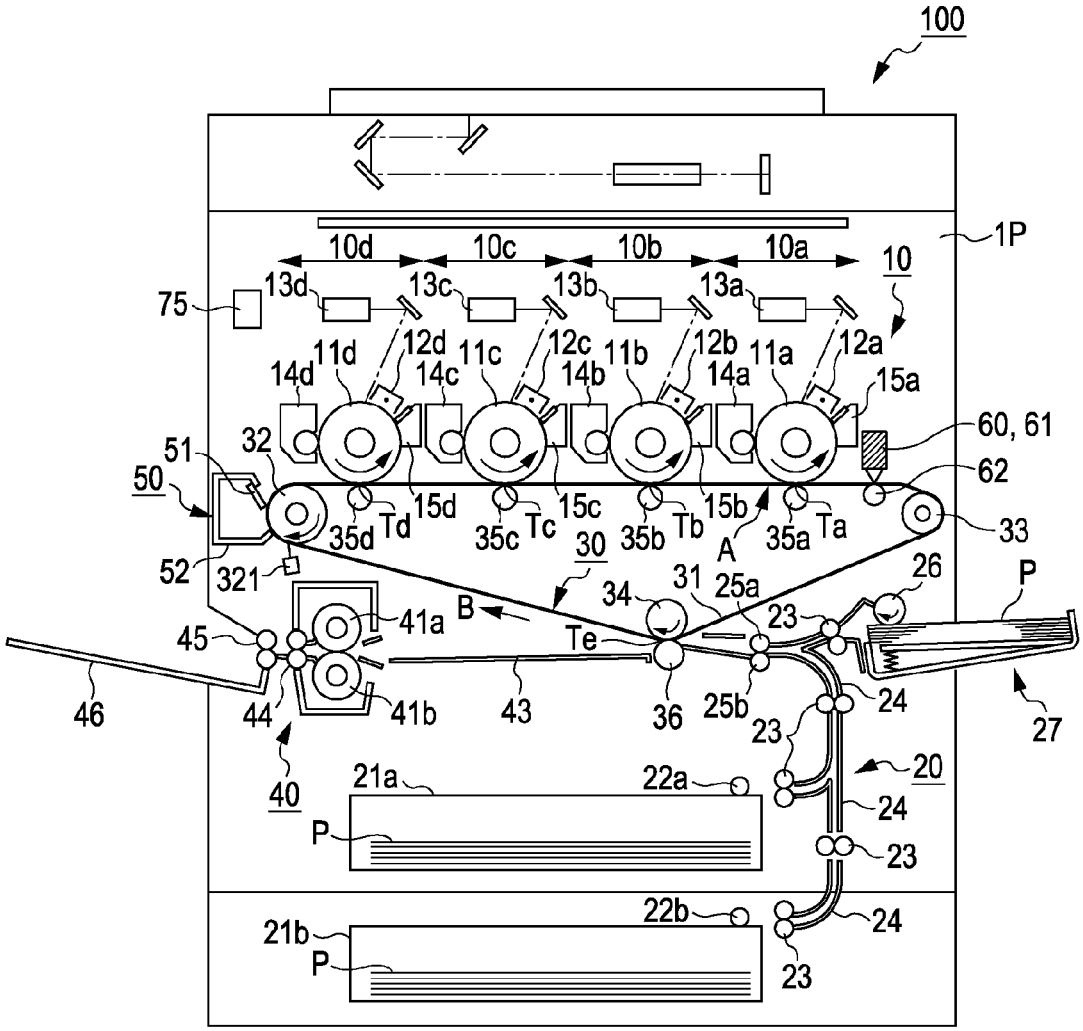
FIG. 1 is a schematic cross-sectional diagram of an image forming apparatus according to a first embodiment of the present invention.

First, a first embodiment of an image forming apparatus according to the present invention will be described. FIG. 1 is a cross-sectional view of the principal components of an image forming apparatus 100 according to an embodiment. The image forming apparatus 100 is a color image forming apparatus wherein multiple image forming units are arrayed.

An image output unit 1P is provided to the color image forming apparatus 100 shown in the drawing. The image output unit 1P is configured in overall of an image forming unit 10 wherein four stations 10*a*, 10*b*, 10*c*, and 10*d* which each have the same configuration are arrayed, a sheet feed unit 20, an intermediate transfer unit 30, a fixing unit 40, and a main apparatus control unit 75. The stations 10*a*, 10*b*, 10*c*, and 10*d* are also individually referred to as image forming units 10*a* through 10*d*.

Now, each of the units will be described in detail. At the image forming unit 10, photosensitive drums 11*a*, 11*b*, 11*c*, and 11*d* are each axially supported on the centers thereof so as to be rotationally driven in the direction indicated by the arrows in the drawing. Facing the perimeter face of the photosensitive drums 11*a* through 11*d* are, in order following the direction of rotation, primary chargers 12*a*, 12*b*, 12*c*, and 12*d*, optical systems 13*a*, 13*b*, 13*c*, and 13*d*, and developing units 14*a*, 14*b*, 14*c*, and 14*d*.

The primary chargers 12*a* through 12*d* uniformly charge the surface of the photosensitive drums 11*a* through 11*d*. Next, the surfaces of the photosensitive drums 11*a* through 11*d* are exposed with a beam such as a laser beam or the like, which has been modulated in accordance with recording image signals, by the optical systems 13*a* through 13*d*, so as to form an electrostatic latent image on each of the photosensitive drums 11*a* through 11*d*. Each electrostatic latent image is then developed with developer (toner) of the respective colors of yellow, cyan, magenta, and black, by the developing units 14*a* through 14*d*, so as to be manifested as toner images.

Downstream of primary transfer regions Ta, Tb, Tc, and Td, where the manifested toner images are transferred onto an intermediate transfer belt 31, the residual toner on the photosensitive drums 11*a* through 11*d* is cleaned. That is to say, any toner remaining on the photosensitive drums 11*a* through 11*d* without being transferred onto the intermediate transfer belt 31 is scraped off by cleaning devices 15*a*, 15*b*, 15*c*, and 15*d*, thereby cleaning the surfaces of the photosensitive drums 11*a* through 11*d*. Thus, formation of images with toner of each color is sequentially carried out according to the above-described process.

On the other hand, the sheet feed unit 20 is configured of cassettes 21*a* and 21*b* and a manual feed tray 27 for storing recording material P, and pickup rollers 22*a* and 22*b*, and 26, for feeding the recording material P out from a cassette 21*a*, 21*b*, or manual feed tray 27, one at a time. The recording material P fed out by the pickup rollers 22*a*, 22*b*, and 26 is transported to the nip between registration rollers 25*a* and 25*b*. Further, the sheet feed unit 20 includes a sheet feed roller pair 23, a sheet feed guide 24, and registration rollers 25*a* and 25*b* for feeding the recording material P to a secondary transfer region Te so as to match a timing at which forming of an image by the image forming unit 10 begins.

Also, the intermediate transfer unit 30 has an intermediate transfer belt 31 serving as an image bearing belt. This intermediate transfer belt 31 has a driving roller 32 for transmitting driving force thereto, and a motor (driving unit) 321 for rotating the driving roller 32. Also provided to the intermediate transfer unit 30 is a backup roller 62 provided facing a registration mark detection sensor 60, and a tension roller 33 which provides the intermediate transfer belt 31 with a suitable tension, by pressing force of an unshown spring. The intermediate transfer belt 31 runs around a secondary transfer roller 34 facing the secondary transfer region Te from the back side of the intermediate transfer belt 31. Suitable materials for the intermediate transfer belt 31 include, for example, PI (polyimide), PVDF (polyvinylidene-fluoride) or the like.

A primary transfer face A is formed between the driving roller 32 and the backup roller 62. The driving roller 32 is a metal roller coated with rubber (urethane or chloroprene) formed to a thickness of several millimeters so as to avoid slippage as to the intermediate transfer belt 31. Note that this driving roller 32 is rotationally driven by a pulse motor (driving unit) 321.

The tension roller 33 pressed by an unshown pressuring mechanism is adjustable with regard to alignment, and accordingly can correct meandering of the intermediate transfer belt 31.

At the primary transfer regions Ta through Td where the intermediate transfer belt 31 faces the photosensitive drums 11*a* through 11*d*, primary transfer devices 35*a* through 35*d* are disposed on the rear side of the intermediate transfer belt 31. Further, a secondary transfer device 36 is disposed facing the secondary transfer roller 34, thereby forming the secondary transfer region Te.

Also, a cleaning device 50 for cleaning the image forming face of the intermediate transfer belt 31 is disposed downstream of the secondary transfer region Te on the intermediate transfer belt 31, the cleaning device 50 being configured of a cleaner blade 51 and waste toner box 52 for recovering waste toner. Also note that polyurethane rubber or the like is used as the material for the cleaner blade 51.

The fixing unit 40 includes a fixing roller 41*a* having a heat source such as a halogen heather or the like within, and a pressure roller 41*b* to be pressed against the fixing roller 41*a*. Note that the pressure roller 41*b* may also be provided with a heat source depending on the arrangement.

The fixing unit 40 also includes a guide 43 for guiding the recording material P to the nip between the fixing roller 41*a* and the pressure roller 41*b*, an inner discharge roller 44 and outer discharge roller 45 for further externally discharging the recording material P, discharged from the fixing roller 41*a* and the pressure roller 41*b*, externally from the apparatus.

The control unit 75 is configured of a control board, motor drive boards, and so forth, for controlling the operations of the mechanisms within each of the above units.

Next, the operations of the image forming apparatus according to an embodiment will be described. Upon an image forming operation start signal being emitted from the main apparatus control unit 75, first, recording material P is fed out from the cassette 21*a* by the pickup roller 22*a*, one sheet at a time. The recording material P is then guided between the sheet feed guides 24 so as to be conveyed to the registration rollers 25*a* and 25*b*. At this time, the registration rollers 25*a* and 25*b* are stopped, so the leading edge of the recording material P abuts against the nip. Subsequently, the registration rollers 25*a* and 25*b* begin rotation, so as to match a timing at which forming of an image by the image forming unit 10 begins. The rotation timing of the registration rollers 25*a* and 25*b* is set at a timing such that the toner image transferred by primary transfer onto the intermediate transfer belt 31 by the image forming unit 10 perfectly matches the recording material P at the secondary transfer region Te.

On the other hand, upon the image forming operation start signal being emitted, primary transfer of the toner image onto the intermediate transfer belt 31 is performed at the image forming unit 10 by the above-described process. That is to say, a toner image is formed on the photosensitive drum 11*d* of the image forming unit (first image forming unit) farthest upstream in the direction of rotation of the intermediate transfer belt 31. This toner image is subjected to primary transfer onto the intermediate transfer belt 31 at the primary transfer region Td, by the primary transfer roller 35*d* upon which high-voltage has been applied.

The toner image subjected to primary transfer onto the intermediate transfer belt 31 is conveyed to the next primary transfer region Tc, where a toner image is formed on the photosensitive drum 11*c* of the image forming unit 10*c* (second image forming unit) is subjected to primary transfer onto the intermediate transfer belt 31. Image forming is performed at the image forming unit 10*c*, delayed by an amount of time equivalent to the time required to transport the toner image between the image forming unit 10*d* and the image forming unit 10*c*. The toner image formed on the photosensitive drum 11*c* is subjected to primary transfer onto the intermediate transfer belt 31 so as to match the relative position of the toner image from the photosensitive drum 11*d* that has been subjected to primary transfer onto the intermediate transfer belt 31. This process is subsequently, repeated until toner images of all four colors are finally subjected to primary transfer onto the intermediate transfer belt 31.

Subsequently, upon the recording material P entering the secondary transfer region Te and coming into contact with the intermediate transfer belt 31, high-voltage is applied to the secondary transfer device 36 at the timing at which the recording material P passes. Thus, the four-color toner image formed on the intermediate transfer belt 31 by the above-described process is transferred onto the surface of the recording material P. The recording material P upon which the toner image has been transferred is accurately guided to the nip between the fixing roller 41*a* and pressure roller 41*b* of the fixing unit 40, by the conveyance guide 43. The toner image is then fixed upon the surface of the recording material P by the heat and nip pressure of the roller pair 41*a* and 41*b* of the fixing unit 40. The recording material P upon which the toner image has been fixed is conveyed by the inner discharge roller 44 and outer discharge roller 45, and discharged to a tray 46.

Now, the photosensitive drums 11, primary chargers 12, optical systems 13, developing units 14, cleaning devices 15, intermediate transfer belt 31, primary transfer devices 35, and secondary transfer device 36, configure a toner image forming mechanism.

Figure 2:
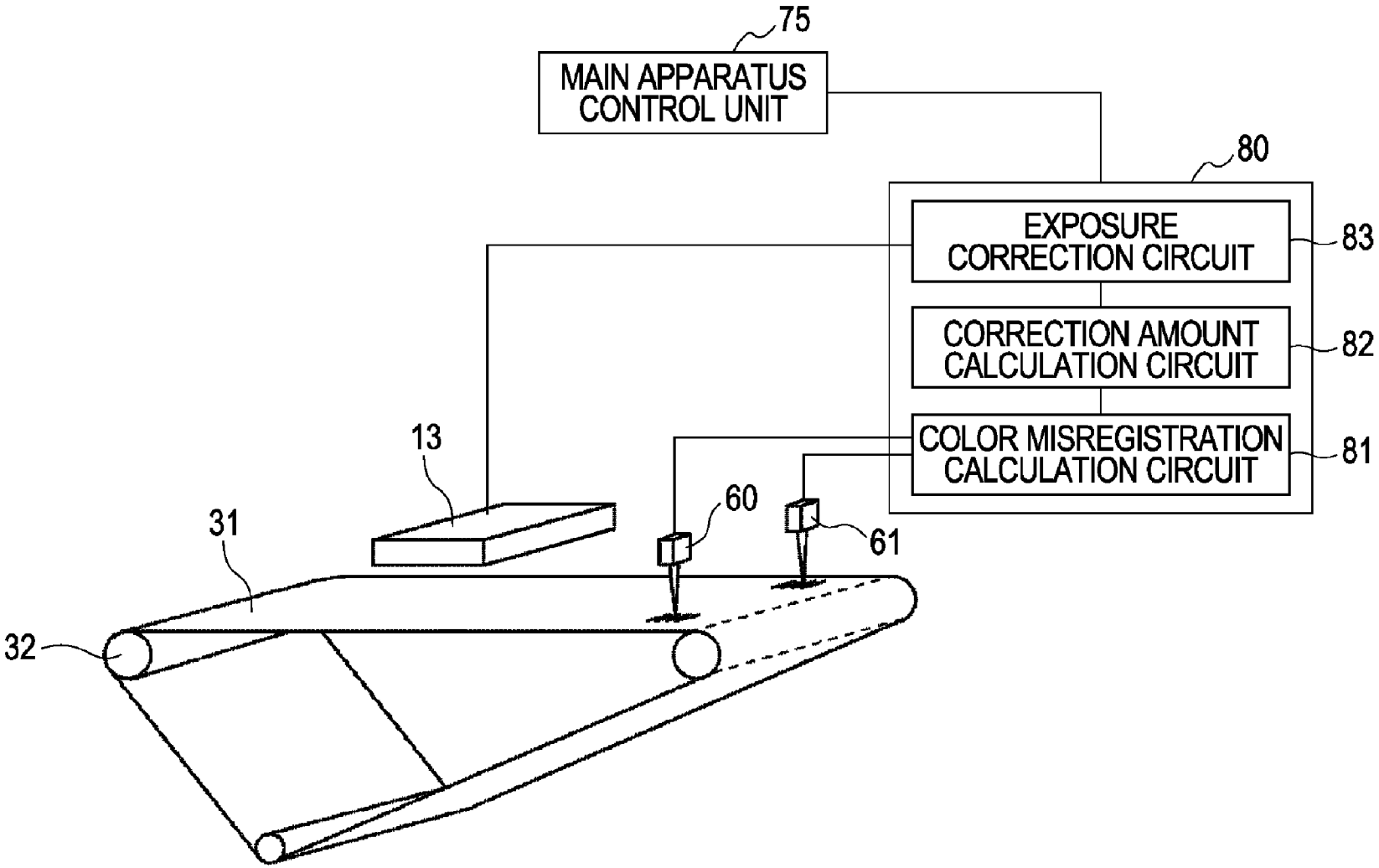
FIG. 2 is a diagram describing a color misregistration control unit according to the first embodiment in detail.

FIG. 2 is a schematic diagram for describing the registration correction mechanism. Registration mark detection sensors 60 and 61 are configured of an LED serving as a light source, and a photoreceptor for detecting reflected light. Electrical signals obtained from the registration mark detection sensors 60 and 61 are sent to a color misregistration correction unit 80, and the amount of color misregistration is calculated at a color misregistration calculation circuit 81.

Figure 3:
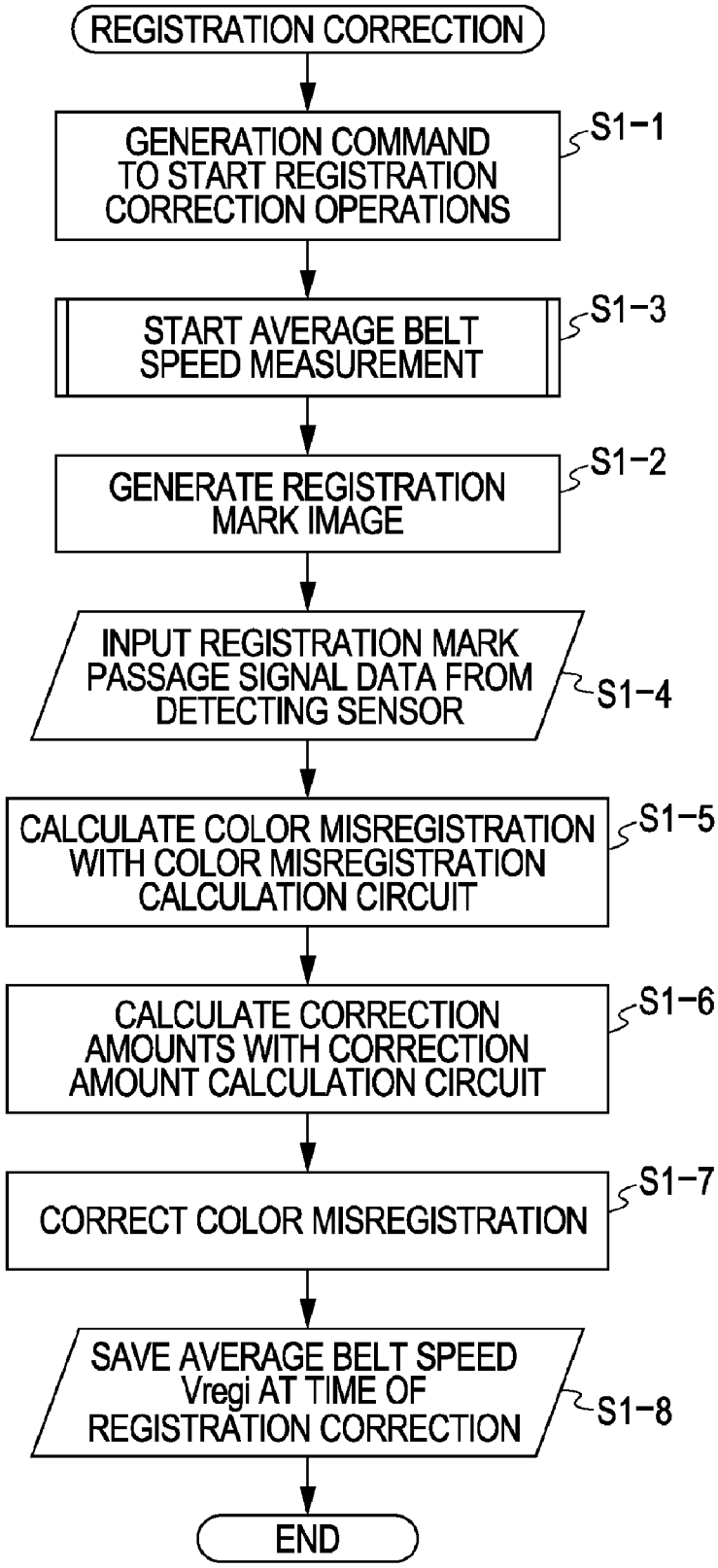
FIG. 3 is a flowchart of registration correction according to an embodiment of the present invention.
Figure 4:
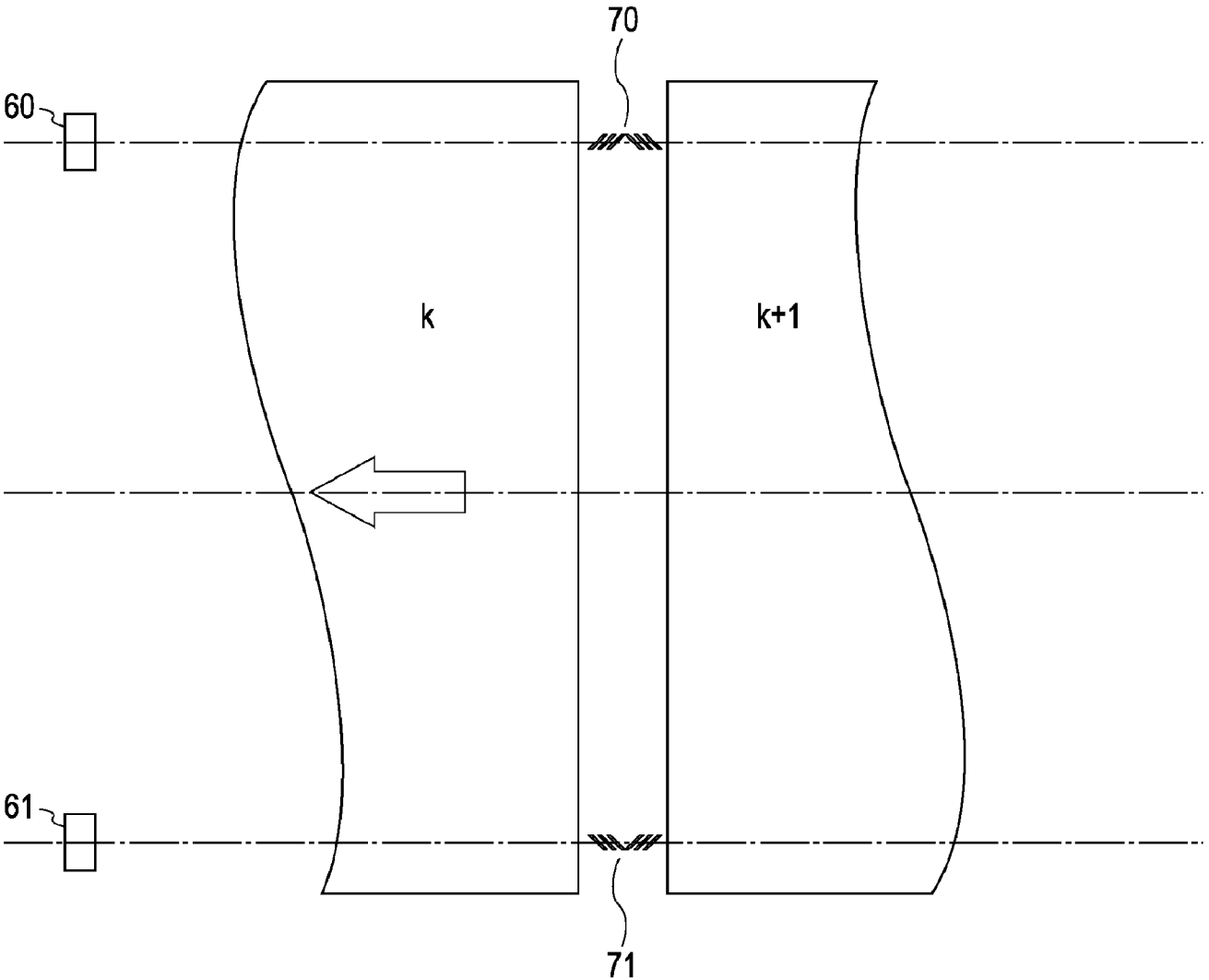
FIG. 4 is a diagram for describing the position of forming a registration mark according to an embodiment of the present invention.
Figure 5:
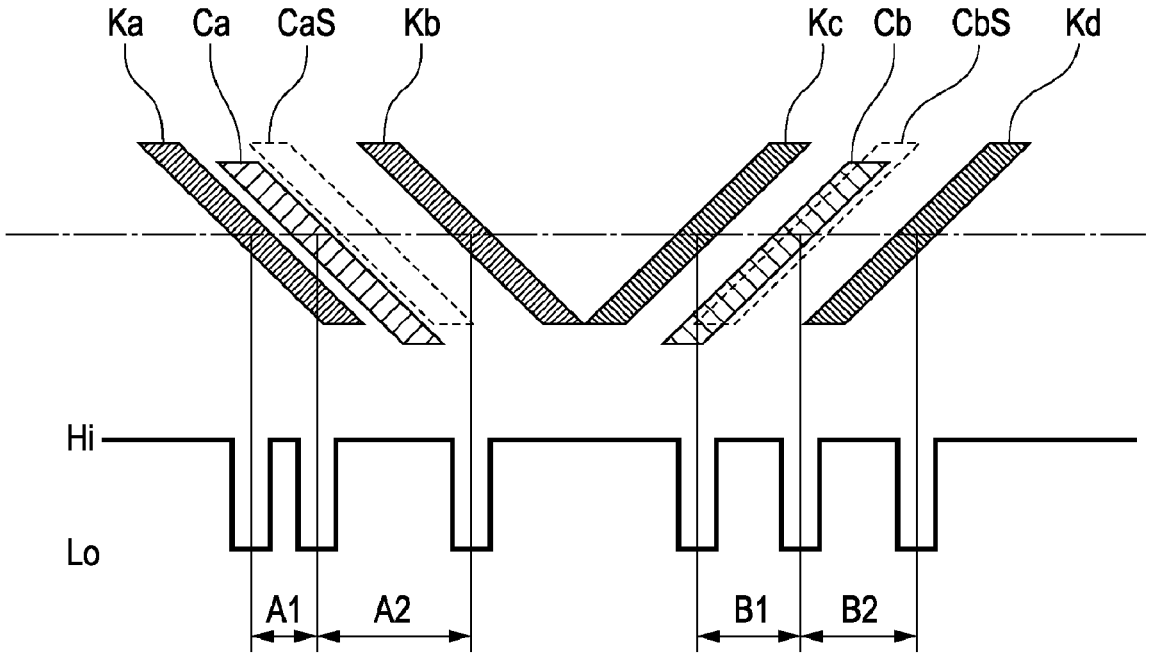
FIG. 5 is a diagram for describing the shape of the registration mark according to an embodiment of the present invention.

FIGS. 4 and 5 illustrate registration marks 70 and 71 for detecting the position of each of the toner images formed on the intermediate transfer belt 31 in detail. These features will be described with reference to the flowchart shown in FIG. 3. Upon starting of the registration correction operations being commanded by the main apparatus control unit 75 (S1-1), the image forming unit 10 starts forming registration marks 70 and 71 (S1-2). At this time, the intermediate transfer belt 31 begins rotating, and measurement of the average speed of the belt, to be described later, is started (S1-3).

The arrow indicates the direction of conveyance of the image, and the registration marks 70 and 71 match the thrust positions of the registration mark detection sensors 60 and 61 (the positions in a direction perpendicular to the direction of rotation of the intermediate transfer belt 31). Each time the images of the registration marks 70 and 71 pass directly beneath the registration mark detection sensors 60 and 61, predetermined electrical signals are obtained (S1-4). For example, as shown in FIG. 5, the registration marks 70 and 71 may be formed as an inclined line Ca of the color to be corrected, formed between inclined lines Ka and Kb of a reference color, and an inclined line Cb of the color to be corrected, formed between inclined lines Kc and Kd of a reference color.

Now, let us say that there is occurring color misregistration of ΔS in the main scanning direction (direction orthogonal to the conveyance direction of the sheet) and ΔH in the sub scanning direction (direction parallel with the conveyance direction of the sheet). In this case, the lines Ca and Cb are formed at positions offset from ideal position lines Cas and Cbs by ΔS and ΔH, respectively. At this time, the output of the registration mark detection sensors 60 and 61 is Hi output at portions where there is no image (the material of the intermediate transfer belt 31) and is Lo at portions where there is an image (portions of the lines Ka, Ca, Kb, Kc, Cb, Kd). Let us represent the distance between center-of-gravity of the output of Lo portions as A1, A2, B1, and B2, respectively. At this time, the color misregistration ΔS in the main scanning direction and the color misregistration ΔH in the sub scanning direction can be calculated by the a color misregistration calculation circuit 81 as follows.

$$\Delta S=\{(B2-B1)/2-(A2-A1)/2\}/2 \quad (8)$$

$$\Delta H=\{(B2-B1)/2+(A2-A1)/2\}/2 \quad (9)$$

Next, the amount of correction necessary for correcting the color misregistration ΔV and ΔH is calculated at the correction amount calculation circuit 82 (S1-6). Further, an exposure correction circuit 83 (correction unit) moves a lens or mirror within the optical system 13 in accordance with the correction amount calculated, and further changes the image write timing and forming frequency, thereby correcting the color misregistration (S1-7). The average speed at the time of registration correction is saved as data upon color misregistration correction having been completed, as registration reference speed Vregi, in order to calculate speed variation described later (S1-8). Such registration correction operations are performed when the power of the apparatus is turned on, after a predetermined number of hours or a predetermined number of copies being made, or at every certain temperature variation, based on temperature information within the apparatus. One example would be to perform registration correction operations one every hour or every 5000 copies printed.

Performing the above-described color misregistration correction on all colors except of the reference color enables all colors to match the reference color.

Next, a configuration which is a feature of an embodiment will be described.

Forming actual registration marks on the intermediate transfer belt 31 in this way and detecting these to perform registration correction enables high-precision color misregistration correction at that point in time. However, this registration correction leads to increased toner consumption since registration marks are being actually formed with toner, and also forming, cleaning, etc., of registration marks results in down-time of the apparatus. Accordingly, intervals between such registration correction operations should be long, from the perspective of productivity of the image forming apparatus.

The problem is that there is temperature change within the apparatus from one registration correction to the next registration correction, and color misregistration may worsen during this time. One factor leading to color misregistration in the variations during this time is change in the diameter of the driving roller 32 of the intermediate transfer belt 31 due to change in temperature.

If the external diameter of the driving roller 32 changes due to a rise in the temperature, this is manifested as change in the conveyance speed of the intermediate transfer belt 31. Accordingly, the image forming position at each image forming unit and the position of images of other colors that are conveyed by the intermediate transfer belt 31, that have been matched by the above registration correction, may not match during a time interval between registration correction operations due to change in temperature, resulting in color misregistration.

Figure 6:
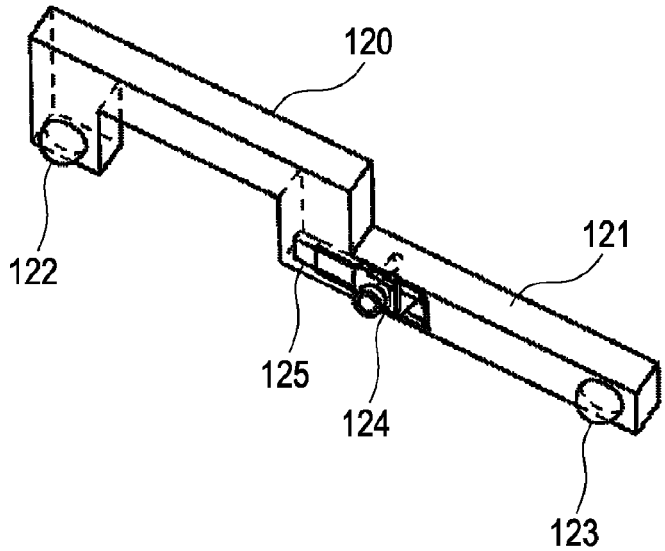
FIG. 6 is a diagram for describing a speed detecting unit according to an embodiment of the present invention in detail.
Figure 8:
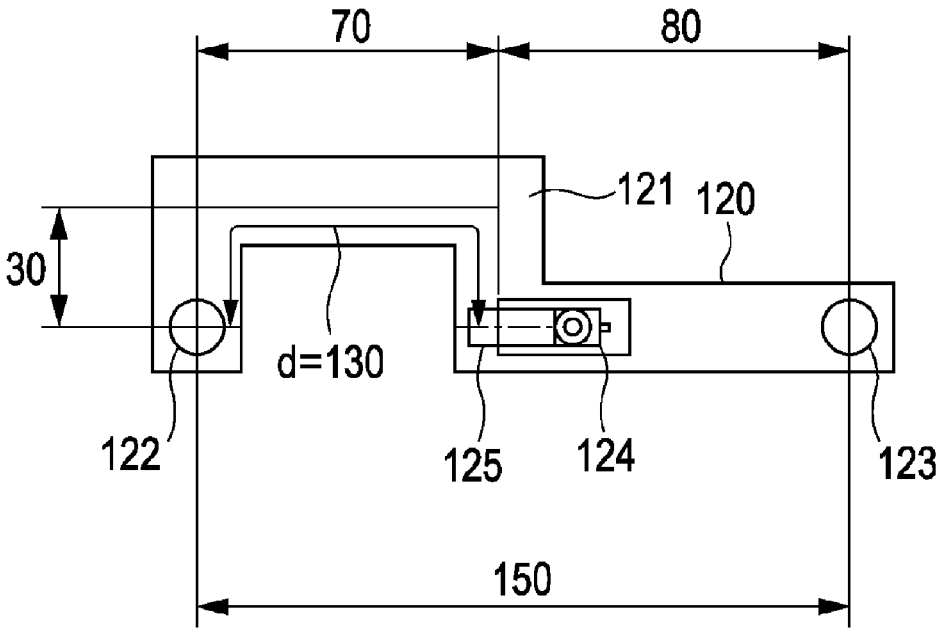
FIG. 8 is a diagram illustrating the speed detecting unit according to an embodiment of the present invention in detail.

In order to prevent or at least mitigate this problem, with an embodiment, a speed detecting unit 120 (mark detecting unit) for detecting the conveyance speed of the intermediate transfer belt 31 is provided on the inner side of the intermediate transfer belt 31, i.e., within the image forming apparatus 100. The speed detecting unit 120 has two speed mark detecting sensors 122 and 123 held on an aluminum supporting member 121 such as shown in FIG. 6, disposed facing the inner side of the intermediate transfer belt 31 as shown in FIG. 4. Also, a line (portion to be detected, i.e., a mark) 129 formed of indelible ink is provided on the inner side of the intermediate transfer belt 31, with the speed mark detecting sensors 122 and 123 being configured so as to change output signals upon this line passing. In an embodiment, the supporting member 121 is formed with a partially bent shape as shown in FIG. 8, so as to avoid interference with other parts.

A temperature sensor 124 (temperature detecting unit) is held by the supporting member 121, such that the temperature detecting unit of the temperature sensor 124 is in direct contact with the aluminum supporting member 121 at a temperature detecting position 125 shown in the drawings, with a contact-type temperature sensor being used for the temperature sensor 124, so as to detect the temperature of the supporting member 121. An alternative arrangement for the temperature sensor 124 is to use an optical temperature sensor which irradiates light on the supporting member 121 and detects temperature.

Now, in the event that there is unevenness in temperature at the supporting member 121, accurately estimating the thermal expansion of the supporting member 121 based on the temperature detection results of the temperature sensor 124 may be difficult. The following is a description regarding the relation between unevenness in temperature due to the physical properties of the supporting member 121, and thermal expansion.

Figure 9:
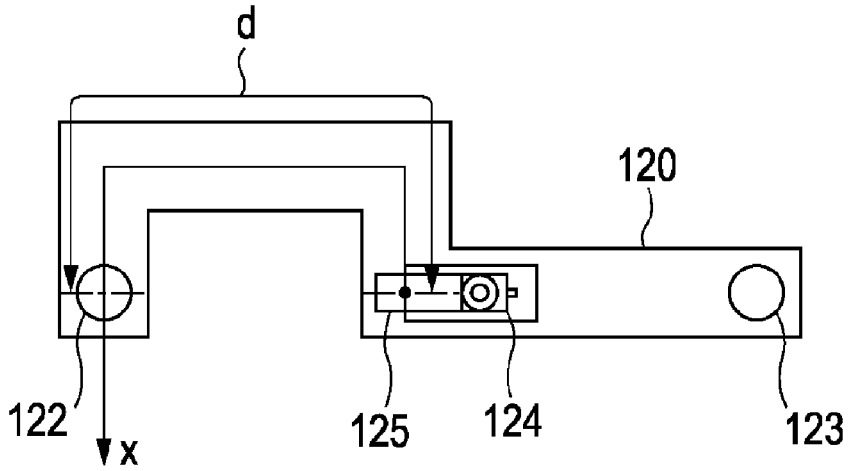
FIG. 9 is a diagram for describing the distance between a temperature detecting unit of the speed detecting unit and sensors according to an embodiment of the present invention.
Figure 10:
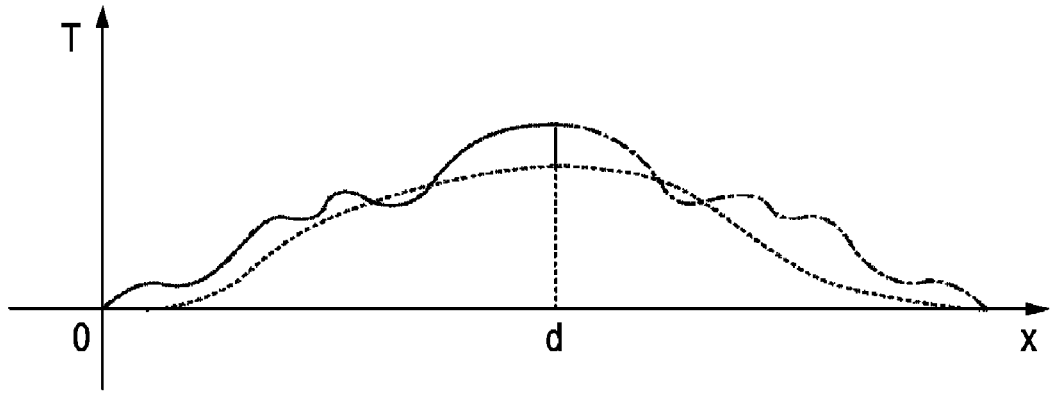
FIG. 10 is a diagram illustrating temperature distribution of a supporting member of the speed mark detecting sensors.

With an arrangement wherein speed mark detecting sensors 122 and 123 are supported on the supporting member 121 as shown in FIG. 9, the path distance from the temperature detecting unit 125 to the farther of the two mark detecting units (122 in the example shown in FIG. 9) will be represented by d, as in FIG. 10. With the direction along this path as the X axis and the temperature difference distribution between the temperature detecting unit 125 and the speed mark detecting sensor 123 as a function T, an arbitrary temperature difference distribution form can be expressed as $$T=a0/2+\Sigma\{an\times\cos(n\times2\pi\times x/2d)+bn\times\sin(n\times2\pi\times x/2d)\} \quad (10)$$

with a Fourier series, wherein n is an integer from 1, 2, 3, and so forth on to infinity, by considering this temperature difference distribution form to be a virtual periodical function of a period 2d folded over symmetrically as shown in FIG. 10.

On the other hand, the temperature distribution within the matter becomes more uniform due to thermal transmission through the matter, following a well-known Fourier equation. The Fourier equation is expressed as follows.

$$\partial T/\partial t=\{\kappa/(\rho\times cp)\}\times(\partial 2T/\partial x2) \quad (11)$$

wherein κ represents thermal conductivity in J/s/m/K, cp represents specific heat in J/K/g, and ρ represents density in $g/m^3$.

Now, let us consider a function T(t, x) wherein T matches Expression (8) at point-in-time t=0 as $$T(t,x)=a0/2+\Sigma\{an\times\exp(-n^2\times t/\tau)\times\cos(n\times 2\pi\times x/2d)+bn\times\exp(-n^2\times t/\tau)\times\sin(n\times 2\pi\times x/2d)\} \quad (12)$$

Substituting this into Expression (9) shows that Expression (9) can be satisfied when $$\tau=\rho\times cp\times d^2/(\pi^2\times\kappa) \quad (13)$$

holds.

That is to say, this shows that the frequency components of an arbitrary temperature difference distribution form coefficient are such that amplitudes an and bn fade to $1/\exp(n^2\times t/(\rho\times cp\times d^2/(\pi^2\times\kappa)))$ as to time t. Here, the component which fades the slowest is the component of the temperature difference distribution form period 2d wherein n=1, with the curve thereof being represented as $\exp(-1\times t/(\rho\times cp\times d^2/(\pi^2\times\kappa)))$.

Now, while exp (−3)=0.0498 (approximately 5%), exp (−4)=0.0183 (approximately 2%), and exp (−5)=0.0067 (approximately 1%), if the original temperature difference distribution form fades to around 2% or lower, this can be said to be almost negligible.

That is to say, even in the event that there is partial temperature difference within the model shown in FIG. 9, a temperature unevenness fading time of te so as to satisfy t in $$-1\times t/(\rho\times cp\times d^2/(\pi^2\times\kappa))=-4 \quad (14)$$

yields a substantially uniform temperature state with $$te=4\times\rho\times cp\times d^2/(\pi^2\times\kappa). \quad (15)$$

Various temperature fluctuations exist within the image forming apparatus. The supporting member 121 supporting the speed mark detection sensors 122 and 123 also is affected by such temperature fluctuations and exhibits local temperature difference distributions. If the above-described time for the temperature to become uniform is sufficiently quick as to the speed of change in temperature fluctuation, temperature unevenness in the supporting member 121 which would interfere with detection for color misregistration is less likely to occur. As for the speed of change in temperature within the image forming apparatus, an estimated amount of time which must elapse in order for the effects of temperature fluctuation to be manifested to the extent that color misregistration correction is necessary is around 3 minutes with the greatest fluctuation (e.g., cold startup, continuous duplex printing, etc.). In fact, many image forming apparatuses perform automatic registration correction operations every 3 minutes, in cases of such great temperature changes.

Accordingly, as long as the material properties ρ, cp, and κ of the mark detecting unit, and the fading time te which is expressed by the distance d from the temperature detection position to the mark detecting unit satisfy $$0<te\leqq 180 \text{ sec} \quad (16)$$

i.e., satisfy $$0<4\times\rho\times cp\times d^2/(\pi^2\times\kappa)\leqq 180 \text{ sec} \quad (17)$$

the temperature non-uniformity error at the time of performing correction of the apparatus taking into consideration the thermal expansion of the supporting member 121 based on the detecting unit temperature can be kept sufficiently small, and color misregistration due to this error can be minimized or prevented.

Figure 11:
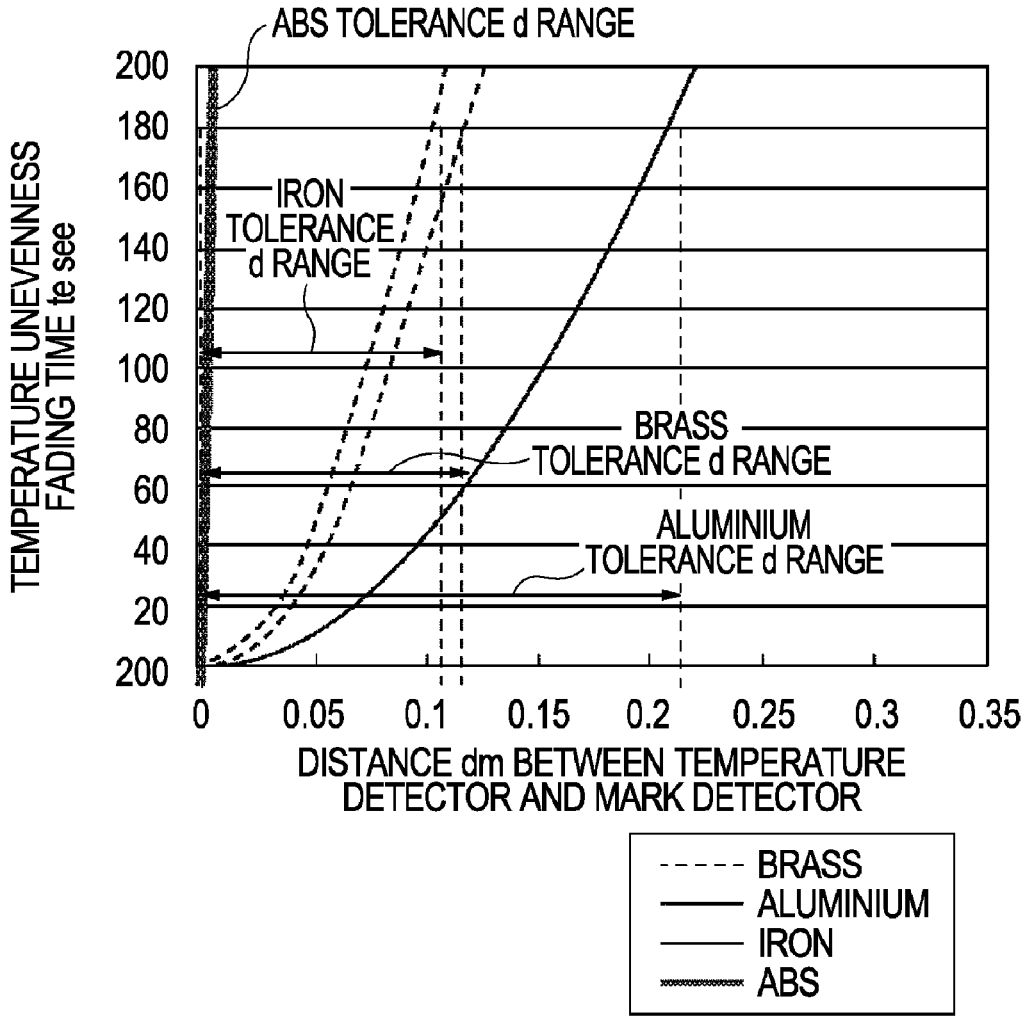
FIG. 11 is a diagram illustrating the relation between a distance d from the temperature detecting unit to the mark detecting unit, and the time of temperature unevenness fading.

Table 1 shows material properties of various materials, and FIG. 11 shows the relation between the distance d and the temperature unevenness fading time te.

TABLE 1

| | | Brass | Aluminum | Iron | ABS |
|---|---|---|---|---|---|
| Thermal conductivity κ | J/(s · m · k) | 106 | 236 | 83.5 | 0.25 |
| Specific heat cp | J/(k · g) | 0.387 | 0.88 | 0.435 | 1.5 |
| Density ρ | $g/cm^3$ | 8.6 | 2.69 | 7.86 | 1.1 |

Now, the distance from the temperature detection position 125 to the sensors is 130 mm for the speed mark detection sensor 122, and 80 mm for the speed mark detection sensor 123 with the distance to the farther sensor as d, $$d=0.13 \text{ m} \quad (18)$$

holds, and since the supporting member 121 is formed of aluminum, thermal conductivity κ is 236 J/s/m/K, specific heat cp is 0.88 J/K/g, and density ρ is 2690000 $g/m^3$. Substituting these in the above-described Expression (15) yields the fading time te in seconds, for temperature distribution at the supporting member 121, which is $$te=68.7 \text{ sec.} \quad (19)$$

This is sufficiently quick as to the speed of temperature change generally occurring at the members within the image forming apparatus, so the temperature of the supporting member 121 can be viewed as being sufficiently uniform within the range between the two speed mark detection sensors 122 and 123 and the temperature detection position 125. That is to say, the thermal expansion of the supporting member 121 can be accurately estimated, based on the temperature information at the temperature detection position 125.

Figure 7:
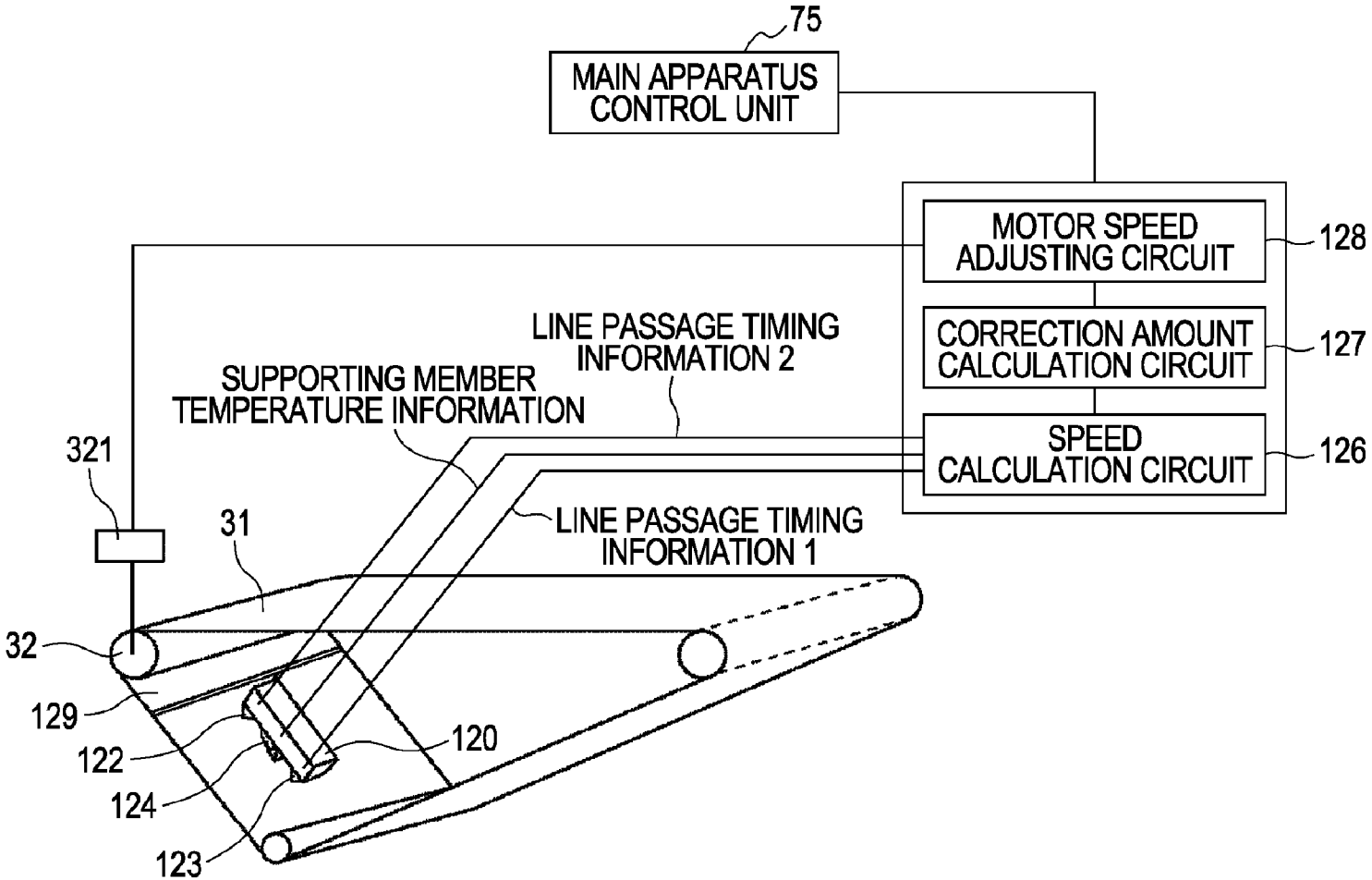
FIG. 7 is a diagram for describing a mechanism for adjusting the rotational speed of a driving roller according to an embodiment of the present invention.
Figure 12:
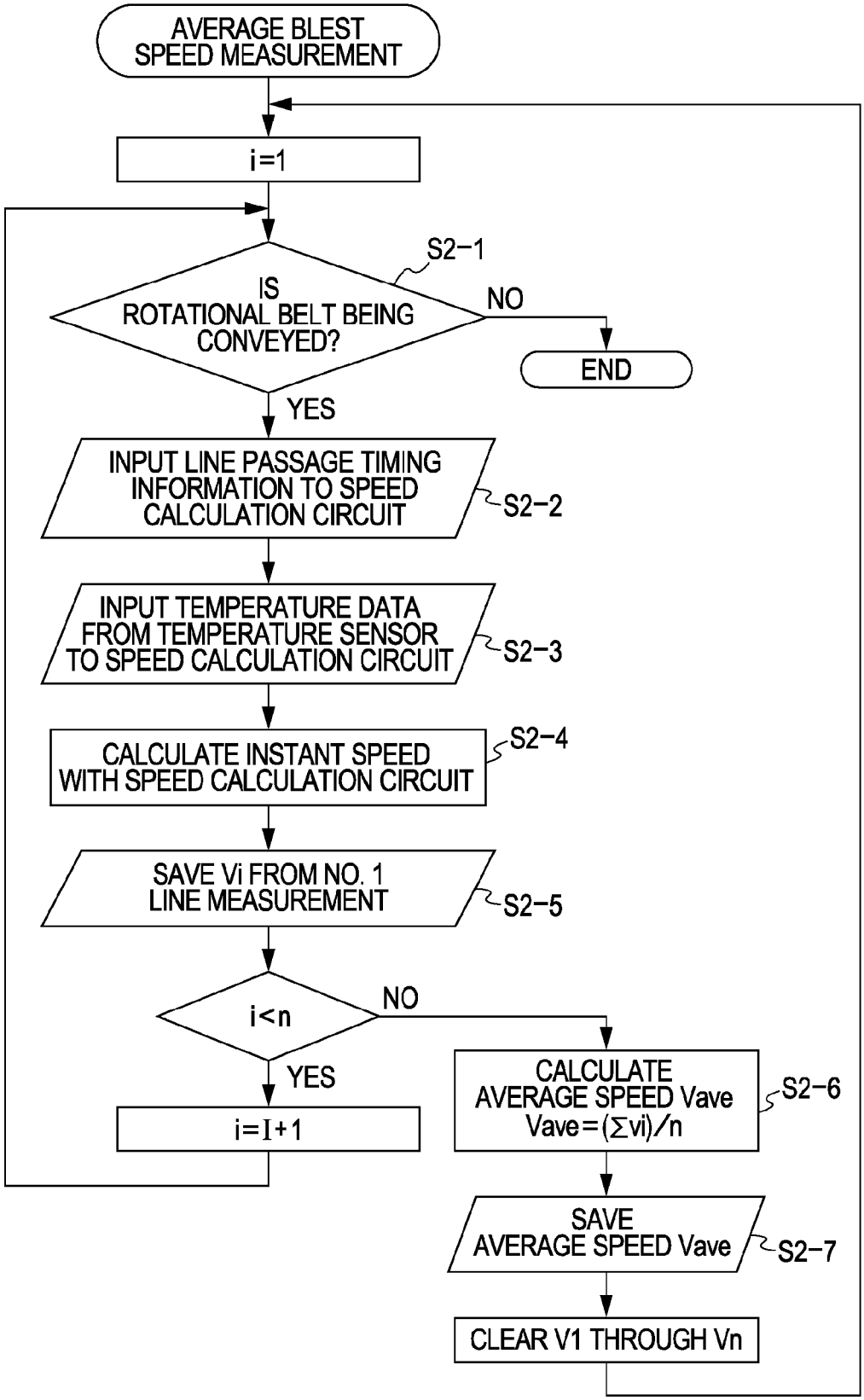
FIG. 12 is a diagram illustrating the flow of average belt speed measurement according to an embodiment of the present invention.

Next, description will be made regarding the operations of measuring the average belt speed, which is performed by the speed detecting unit 120 shown in FIG. 7. FIG. 12 is a flowchart for average belt speed measurement.

In the event that the intermediate transfer belt 31 is being rotated (S2-1), the line 129 passes in front of the two speed mark detection sensors 122 and 123. At this time, the speed mark detection sensors 122 and 123 output line passage timing information which is offset between the two sensors due to the distance therebetween, which is input to a speed calculation circuit 126 (S2-2). Also, the temperature information at that time is input from the temperature sensor 124 to the speed calculation circuit 126 (S2-3). The speed calculation circuit 126 calculates the instant speed Vi of the intermediate transfer belt, based on the following relational expression (S2-4).

$$Vi=R\times(1+\Delta T\times\alpha)/\Delta t$$

wherein R represents the designed distance between the speed mark detection sensors 122 and 123 in mm, ΔT represents the amount of change in temperature from the designed temperature of the temperature sensor 124 (the temperature stipulating the designed distance R) in degrees centigrade, α represents the linear expansion coefficient of the supporting member 121, and Δt is the difference in line passage timing between the speed mark detection sensors 122 and 123 in seconds. Note that the instant speed Vi can be calculated from information related to the designed distance R, instead of the designed distance R. With an embodiment, the supporting member 12 is aluminum, so $\alpha=2.4\times10^{-6}$ (1/deg).

This Vi also includes speed fluctuation in short cycles due to eccentricity of the driving roller 32 and so forth, with the present embodiment, correction is made regarding change to the average speed of the intermediate transfer belt 31, so this Vi is saved at the speed calculating circuit each time the line 129 passes (S2-5). A predetermined number of times is averaged (with the present embodiment, 50 lines 129 are formed on the inner face of the intermediate transfer belt 31, and the predetermined number of times is 50 times, i.e., one rotation of the intermediate transfer belt 31), the average speed change Vave of the intermediate transfer belt 31 is calculated (S2-6), and saved (S2-7). This detection, calculation, updating, and saving of the average speed Vave is constantly performed while the intermediate transfer belt 31 is being rotationally driven.

Figure 13:
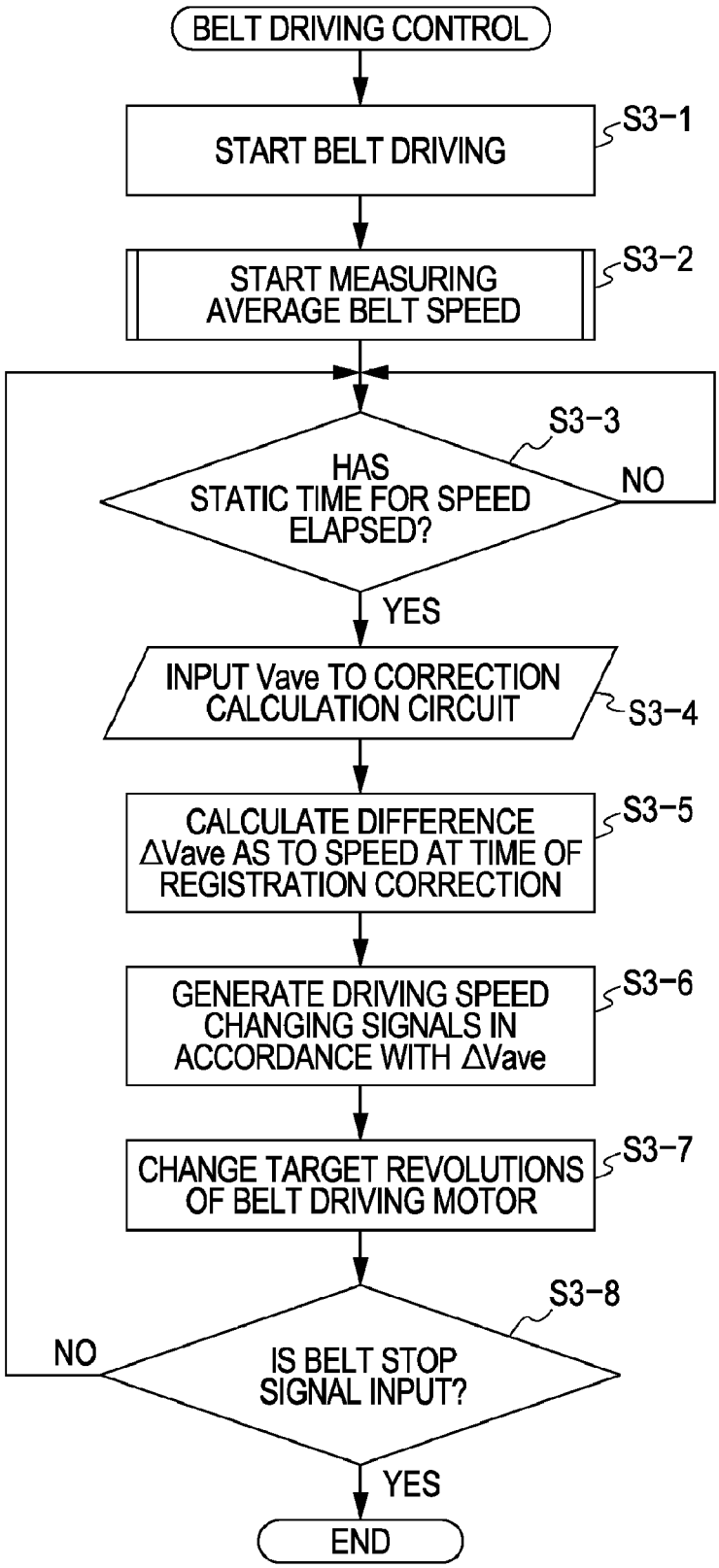
FIG. 13 is a diagram illustrating the flow of belt driving control according to an embodiment of the present invention.

Next, description will be made regarding intermediate transfer belt driving control using the average speed Vave which has been detected and calculated. FIG. 13 is a flowchart of intermediate transfer belt driving control.

In the case of an embodiment of the present invention, the amount of color misregistration ΔX which occurs in the event that the average speed Vave changes from the reference average speed Vregi at the time of performing registration correction can be expressed as $$\Delta X=L/V\times(Vave-Vregi)\text{ mm}$$

since the interval L between the image forming units farthest from each other is 300 mm and the conveyance speed V of the intermediate transfer belt 31 is 300 mm/sec. If we say that $$\Delta Vave=Vave-Vregi,$$

the tolerance ΔVlim of ΔVave with the tolerance of ΔX as 0.01 mm, as an example, is $$\Delta Vlim=0.01\times V/L=0.01\text{ mm/sec}$$

from the above expression.

With an embodiment, driving control is performed such that the change ΔVave of average speed of the intermediate transfer belt 31 from the time of registration correction does not exceed the above ΔVlim.

Upon driving of the belt for forming an image starting (S3-1), the aforementioned average belt speed measurement is started at the same time (S3-2). After a predetermined amount of speed stabilizing time, which is the amount of time over which speed instability immediately following startup or immediately following speed change stabilizes (S3-3), the average speed Vave of the belt is input to the correction amount calculation circuit 127 (S3-4).

The belt speed Vregi at the time of registration correction, which has been saved beforehand, and the above Vave are compared at the correction amount calculation circuit 127 (S3-5), and driving speed changing signals corresponding to this difference are generated (S3-6). These driving speed changing signals are input to the motor speed adjusting circuit (rotation speed adjusting unit) 128, and the target revolutions of the belt driving motor are changed (S3-7). Changing of the target revolutions of the belt driving motor is continued in real-time until a belt stop signal is input (S3-8).

As described above, measuring the temperature of the supporting member 121 enables driving speed correction taking into consideration the thermal expansion of the supporting member 121, whereby color misregistration can be corrected with high precision.

With an embodiment, description has been made regarding an arrangement wherein the rotation speed of the driving roller 32 is adjusted based on the detection results of the speed detecting unit 120 and the temperature sensor 124. It should be noted however, that an arrangement may be made wherein the exposure correction circuit 83 is operated based on the detection results of the speed detecting unit 120 and temperature sensor 124, so as to move a lens or mirror within the optical system 13 or change the image write timing or forming frequency, thereby correcting the color misregistration. That is to say, color misregistration can also be corrected with high precision by adjusting the position of toner images one to another (relative position) formed on the intermediate transfer belt 31 by the image forming units 10*a* through 10*d*, based on the detection results of the speed detecting unit 120 and temperature sensor 124. At this time, the position of toner images one to another (relative position) formed on the intermediate transfer belt 31 is adjusted by the exposure correction circuit 83.

Also, while aluminum has been described as the material used for the supporting member 121 in the present embodiment, an Invar alloy with a small linear expansion coefficient α (an alloy of 36% nickel and 64% iron) may be used instead. The linear expansion coefficient α of Invar alloy is $1.2\times10^{-6}$ (1/deg).

Second Embodiment

Figure 14:
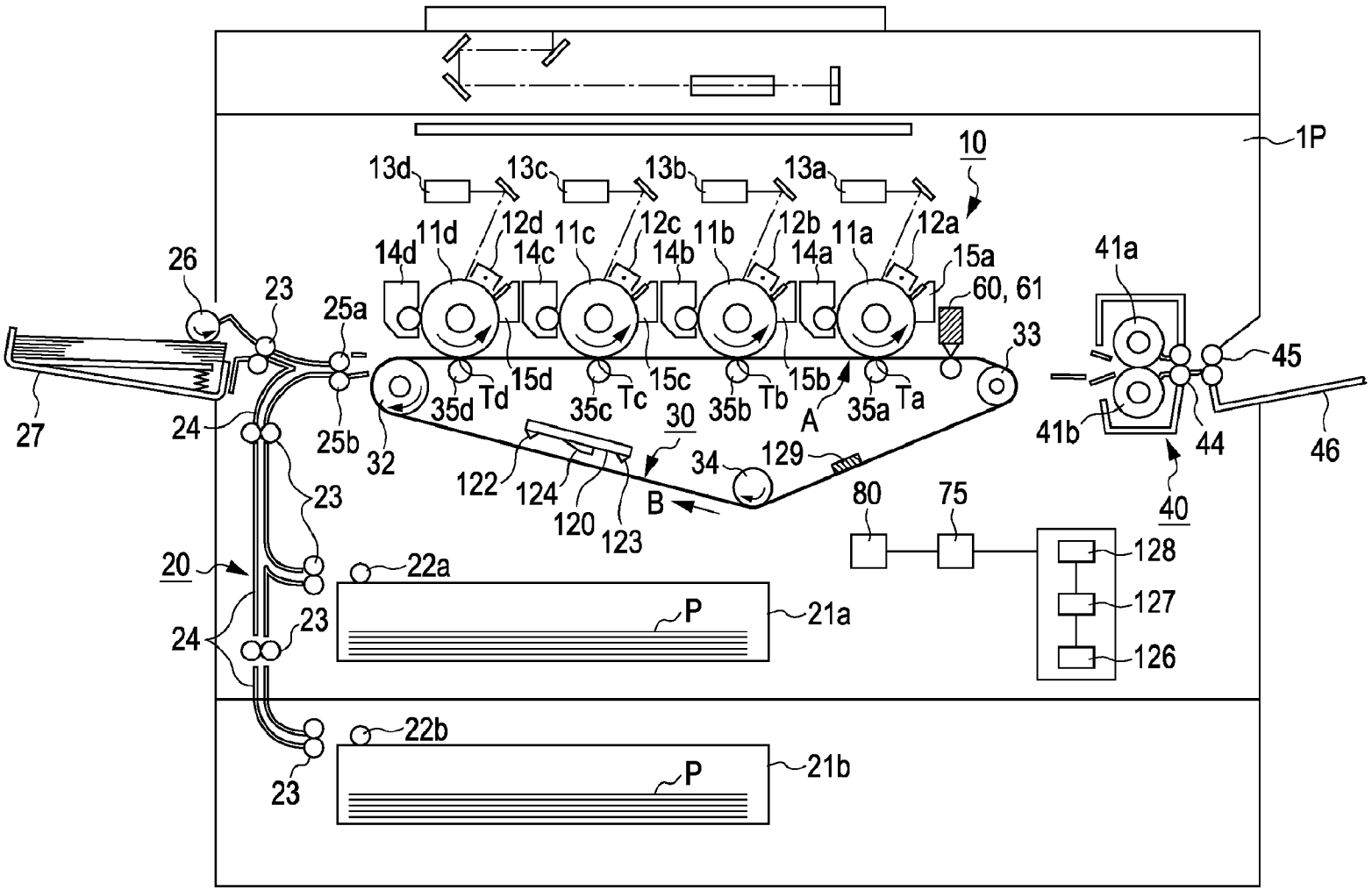
FIG. 14 is a schematic cross-sectional diagram of an image forming apparatus according to a second embodiment of the present invention.

FIG. 14 illustrates an image forming apparatus 200 according to a second embodiment of the present invention. The configuration of the image forming apparatus 200 according to the present embodiment is generally the same as that of the image forming apparatus 100, however, a major difference is in that the intermediate transfer belt 31 of the image forming apparatus 100 is replaced with a recording material conveying belt 90. The image forming units 10*a*, 10*b*, 10*c*, and 10*d* are the same as those of the image forming apparatus 100. Components of the image forming apparatus 200 which are the same as those of the image forming apparatus 100 are denoted with the same reference numerals, and description thereof will be omitted to avoid redundancy.

The recording material P fed out from the cassette 21*a* to the recording material conveying belt 90 is conveyed by the recording material conveying belt 90 and sequentially has transferred thereupon toner images from the image forming units 10*a*, 10*b*, 10*c*, and 10*d*.

Registration marks 70 and 71 formed on the recording material conveying belt 90 by the image forming unit 10 are detected by the registration mark detection sensors 60 and 61. The color misregistration correction unit 80 performs color misregistration correction based on the detection signals of the registration mark detection sensors 60 and 61, in the same way as with the image forming apparatus 100.

In the event that the results of detecting the lines 129 with the mark detecting unit 120 in the same way as with the first embodiment show that the speed of the recording material conveying belt 90 differs from the desired speed, the revolutions of the driving roller 32 are adjusted taking into consideration the detection results of the temperature sensor 124. With an image forming apparatus which performs direct transfer, measuring the temperature of the supporting member 121 enables driving speed correction taking into consideration the thermal expansion of the supporting member 121, whereby color misregistration can be alleviated, in the same way as with the first embodiment.

Also, as with the first embodiment, an arrangement may be made wherein the exposure correction circuit 83 is operated based on the detection results of the mark detecting unit 120 and temperature sensor 124, so as to move a lens or mirror within the optical system 13 or change the image write timing or forming frequency, thereby correcting the color misregistration.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2006-175572 filed Jun. 26, 2006, which is hereby incorporated by reference herein in its entirety.

What is claimed is:

1. An image forming apparatus comprising:

an image bearing belt configured to bear a toner image;

a driving roller configured to rotationally drive the image bearing belt;

first and second image forming units configured to form toner images on the image bearing belt;

a first sensor configured to detect a mark on the image bearing belt;

a second sensor provided on a position different from that of the first sensor in a rotation direction of the image bearing belt, the second sensor being configured to detect the mark;

a supporting member configured to support the first and second sensors;

a temperature detecting unit configured to detect temperature within the image forming apparatus; and a rotational speed adjusting unit configured to adjust a rotational speed of the driving roller, based on detection results of the first and second sensors and of the temperature detecting unit, wherein the first sensor is provided upstream of the second sensor in the rotation direction of the image bearing belt, and wherein the rotational speed adjusting unit adjusts the rotational speed of the driving roller, based on an amount of time from the first sensor detecting the mark to the second sensor detecting the mark, by correcting information relating to the distance between the first sensor and the second sensor in the rotation direction of the image bearing belt, based on detection results of the temperature detecting unit.

2. An image forming apparatus comprising:

an image bearing belt configured to bear a toner image;

a driving roller configured to rotationally drive the image bearing belt;

first and second image forming units configured to form toner images on the image bearing belt;

a first sensor configured to detect a mark on the image bearing belt;

a second sensor provided on a position different from that of the first sensor in a rotation direction of the image bearing belt, the second sensor being configured to detect the mark;

a supporting member configured to support the first and second sensors;

a temperature detecting unit configured to detect temperature within the image forming apparatus; and an adjusting unit configured to adjust a relative position of a toner image formed on the image bearing belt by the first image forming unit and toner image formed on the image bearing belt by the second image forming unit, based on detection results of the first and second sensors and of the temperature detecting unit, wherein the first sensor is provided upstream of the second sensor in the rotation direction of the image bearing belt, and wherein the adjusting unit adjusts the relative position, based on an amount of time from the first sensor detecting the mark to the second sensor detecting the mark, by correcting the information relating to the distance between the first sensor and the second sensor in the rotation direction of the image bearing belt, based on detection results of the temperature detecting unit.

3. An image forming apparatus comprising:

a rotatable image bearing belt configured to bear a toner image;

a driving roller configured to rotationally drive the image bearing belt;

first and second image forming units configured to form toner images on the image bearing belt;

a first sensor configured to detect a mark on the image bearing belt;

a second sensor provided on a position different from that of the first sensor in a rotation direction of the image bearing belt, the second sensor being configured to detect the mark;

a supporting member configured to support the first and second sensors;

a temperature detecting member configured to detect the temperature of the supporting member;

a calculation unit configured to calculate a moving speed of the image bearing belt based on an amount of variation in the distance between the first sensor and the second sensor to be obtained from the temperature of the supporting member and an output of the first and second sensors; and an adjusting unit configured to adjust the moving speed of the image bearing belt based on the moving speed calculated by the calculation unit.

4. The image forming apparatus according to claim 3, wherein the calculation unit is configured to calculate the moving speed of the image bearing belt based on a distance calculated by adding or subtracting the amount of variation to or from the distance between the first sensor and the second sensor input in advance.

5. The image forming apparatus according to claim 3, wherein the adjusting unit is configured to adjust the moving speed of the image bearing belt so that the moving sped is within a predetermined range in relation to a reference speed.

6. The image forming apparatus according to claim 5, further comprising a performing unit configured to perform an operation to adjust an image forming condition by detecting positions of marks that the first and second image forming units formed on the image bearing belt, wherein the reference speed is determined by the operation.

7. The image forming apparatus according to claim 3, wherein a relation of density ρ, specific heat cp and thermal conductivity κ of the supporting member and the distance $d^2$ between a part of the supporting member at which the detecting member detects the temperature of the supporting member and a sensor away from the part satisfies the following expression:

$$0<4\times\rho\times cp\times d^2/(\pi^2\times\kappa)\leqq 180 \text{ sec.}$$

8. An image forming apparatus comprising:

a rotatable image bearing belt configured to bear a toner image;

a driving roller configured to rotationally drive the image bearing belt;

first and second image forming units configured to form toner images on the image bearing belt;

a first sensor configured to detect a mark on the image bearing belt;

a second sensor provided on a position different from that of the first sensor in a rotation direction of the image bearing belt, the second sensor being configured to detect the mark;

a supporting member configured to support the first and second sensors;

a temperature detecting member configured to detect the temperature of the supporting member;

a calculation unit configured to calculate moving speed of the image bearing belt based on an amount of variation in the distance between the first sensor and the second sensor to be obtained from the temperature of the supporting member and an output of the first and second sensors; and an adjusting unit configured to adjust a relative position of a toner image formed on the image bearing belt by the first image forming unit and a toner image formed on the image bearing belt by the second image forming unit, based on the moving speed calculated by the calculation unit.

9. The image forming apparatus according to claim 8, wherein the calculation unit is configured to calculate the moving speed of the image bearing belt based on a distance calculated by adding or subtracting the amount of variation to or from the distance between the first sensor and the second sensor input in advance.

10. The image forming apparatus according to claim 8, wherein the adjusting unit is configured to adjust the moving speed of the image bearing belt so that the moving sped is within a predetermined range in relation to a reference speed.

11. The image forming apparatus according to claim 10, further comprising a performing unit configured to perform an operation to adjust an image forming condition by detecting positions of marks that the first and second image forming units formed on the image bearing belt, wherein the reference speed is determined by the operation.

12. The image forming apparatus according to claim 8, wherein a relation of density ρ, specific heat cp and thermal conductivity κ of the supporting member and the distance $d^2$ between a part of the supporting member at which the detecting member detects the temperature of the supporting member and a sensor away from the part satisfies the following expression:

$$0<4\times\rho\times cp\times d^2/(\pi^2\times\kappa)\leqq 180 \text{ sec.}$$

* * * * *